US010464749B2

(12) United States Patent
Shek

(10) Patent No.: US 10,464,749 B2
(45) Date of Patent: Nov. 5, 2019

(54) LID BODY

(71) Applicant: Michael Shek, San Mateo, CA (US)

(72) Inventor: Michael Shek, San Mateo, CA (US)

( * ) Notice: Subject to any disclaimer, the term of this patent is extended or adjusted under 35 U.S.C. 154(b) by 416 days.

(21) Appl. No.: 15/429,565

(22) Filed: Feb. 10, 2017

(65) Prior Publication Data

US 2018/0229931 A1 Aug. 16, 2018

(51) Int. Cl.
*B65F 1/16* (2006.01)

(52) U.S. Cl.
CPC ..... *B65F 1/1638* (2013.01); *B65F 2210/128* (2013.01); *B65F 2210/168* (2013.01)

(58) Field of Classification Search
CPC ..... B65F 1/1638; B65F 2210/128
USPC ..... 318/139
See application file for complete search history.

(56) References Cited

U.S. PATENT DOCUMENTS 6,596,983 B2 * 7/2003 Brent ..... B65F 1/1638 160/7
7,741,801 B2 * 6/2010 Fukuizumi ..... B65F 1/1638 220/260
2008/0296298 A1 * 12/2008 Wang ..... B65F 1/1607 220/260
2017/0096299 A1 * 4/2017 Yang ..... B65F 1/1638

FOREIGN PATENT DOCUMENTS

TW M317423 8/2007

* cited by examiner

*Primary Examiner* — Kawing Chan

(74) *Attorney, Agent, or Firm* — Muncy, Geissler, Olds & Lowe, P.C.

(57) ABSTRACT

A lid body is provided for being assembled on a barrel body and defining a receiving space with the barrel body, and the lid body includes a main body and an opening and closing system. The main body has an opening for communicating with the receiving space. At least one of sensing unit of the opening and closing system is angle-adjustably disposed on the main body, each said sensing unit and an object to be sensed have a sensing distance therebetween along a sensing direction, a length of the sensing distance projected to a detection plane is defined as a detection range, and the detection range changes according to change of the angle of the sensing unit relative to the main body.

7 Claims, 6 Drawing Sheets

LID BODY

BACKGROUND OF THE INVENTION

Field of the Invention

The present invention relates to a lid body of a container assembly.

Description of the Prior Art

Usually, a lid member of a simple container covers on a barrel body, so when a user wants to put an object into the barrel body or take the object out from the barrel body, s/he needs to move the lid member with hand; therefore, when the container is served as a trash can, the user's hand easily becomes dirty. To improve this kind of problems, an inductive lid body is provided, the lid member of the inductive lid body can sense if a item approaches and open automatically, so the user does not need to lift the lid member with hand. This type of lid body is disclosed in TWM317423.

However, in this type of lid body, a sensing distance of a sensor which senses the item approaches is fixed; that is, a detection range of the lid body is fixed and cannot be adjusted according different requirements. In other words, the user must empty other foreign matters in the detection range of the lid body, or the lid member of the lid body will keep in an open state.

The present invention has arisen to mitigate and/or obviate the afore-described disadvantages.

SUMMARY OF THE INVENTION

The major object of the present invention is to provide a lid body which can change a dimension of a detection range according to different needs through adjusting an angle of a sensing unit so that it is more useful and convenient for the user to use the lid body.

To achieve the above and other objects, a lid body is provided for being assembled on a barrel body and defining a receiving space with the barrel body, and the lid body includes a main body and an opening and closing system. The main body has an opening for communicating with the receiving space; the opening and closing system is disposed on the main body and includes a lid member, a processing unit, at least one sensing unit and a driving unit, the lid member is movably assembled on the main body and normally covers the opening, each said sensing unit and an object to be sensed have a sensing distance therebetween along a sensing direction, each said sensing unit is angle-adjustably disposed on the main body, each said sensing unit is electrically connected to the processing unit, and the driving unit is electrically connected to and between the processing unit and the lid member. A length of the sensing distance projected to a detection plane is defined as a detection range, and the detection range changes according to change of the angle of the sensing unit relative to the main body. As the sensing unit senses the object, the sensing unit transmits a signal to the processing unit; and as the processing unit receives the signal, the processing unit actuates the driving unit to drive the lid member to move to an opening position to cover the opening partly.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
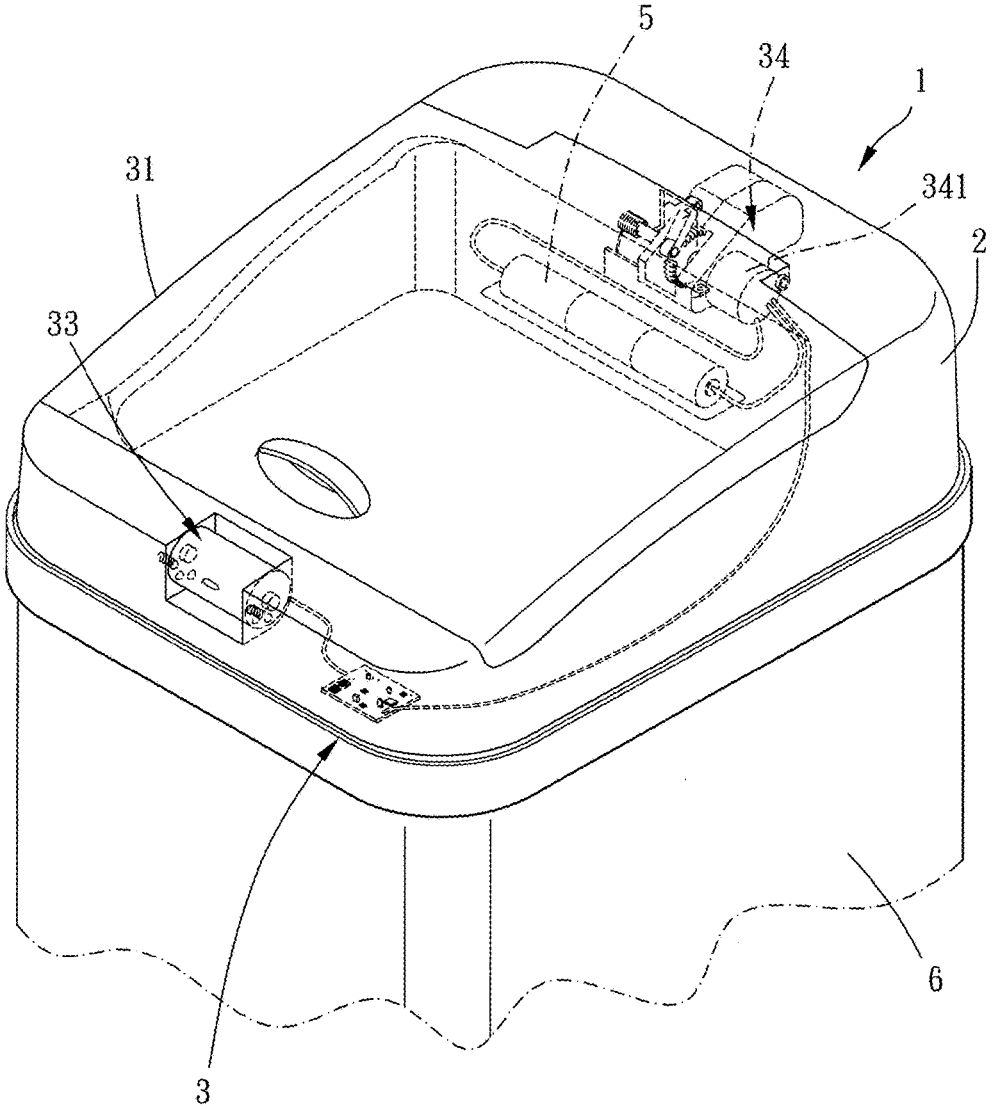
FIG. 1 is a stereogram of an embodiment of the present invention.
Figure 2:
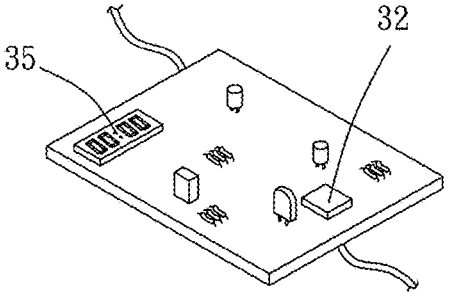
FIG. 2 is a partially-enlarged view of FIG. 1.
Figure 3:
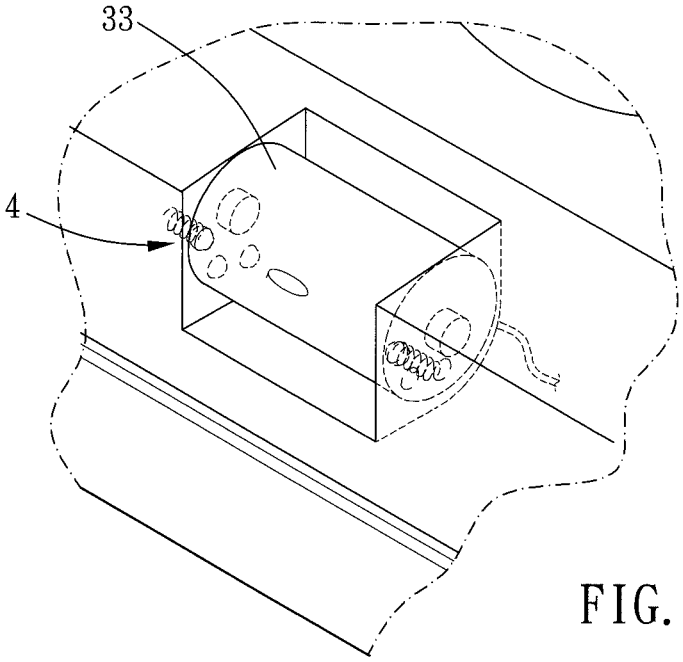
FIG. 3 is another partially-enlarged view of FIG. 1.
Figure 4:
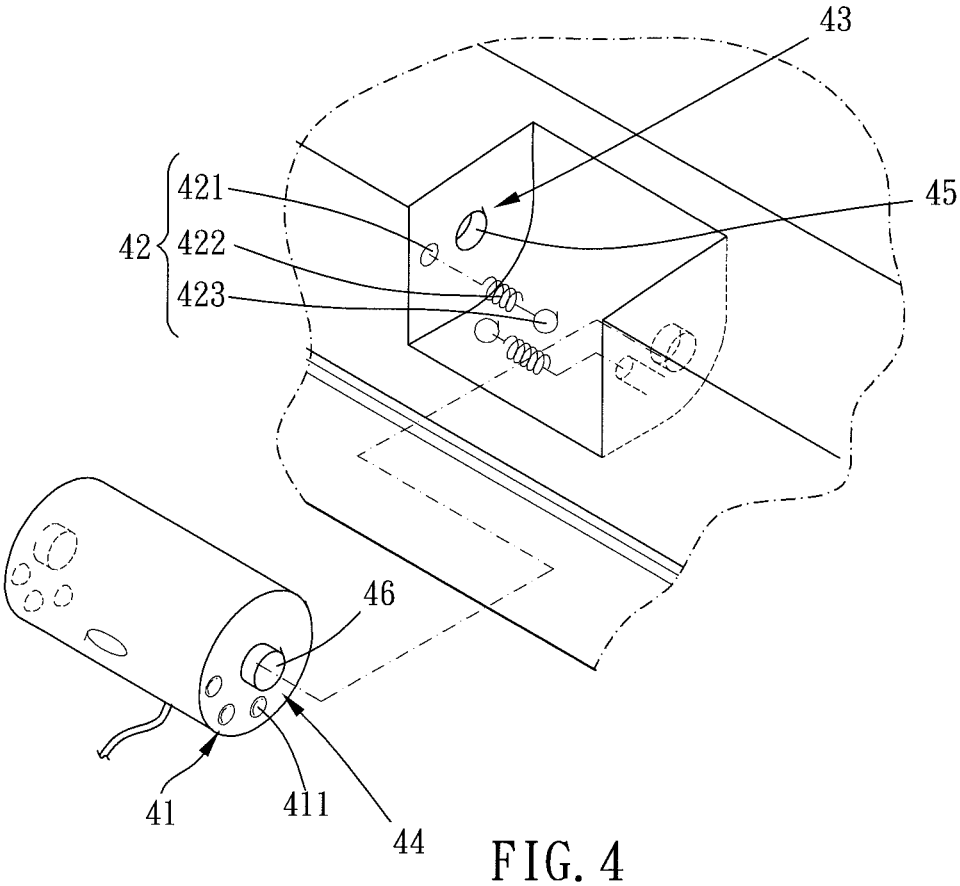
FIG. 4 is a breakdown view of the FIG. 3.
Figure 5:
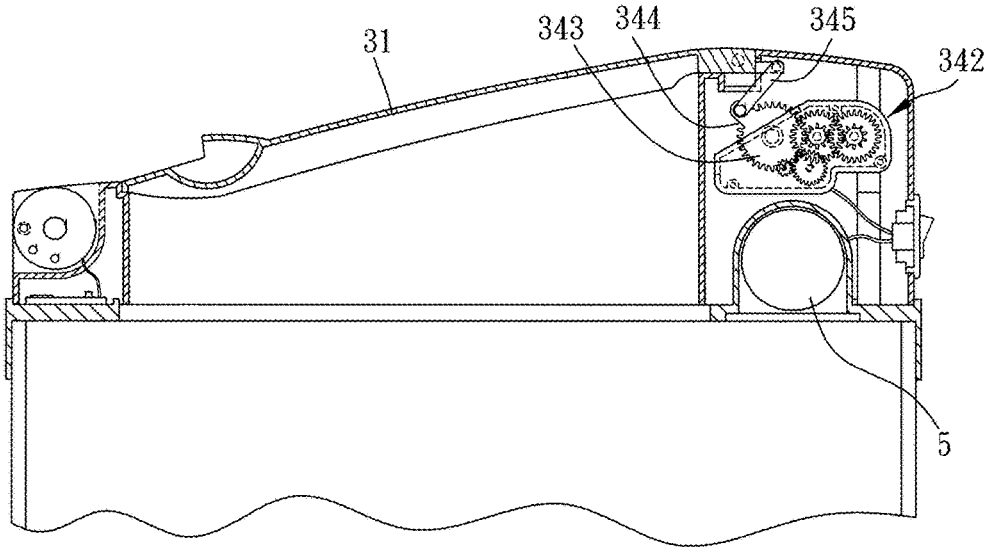
FIGS. 5 and 6 are side views showing the embodiment of the present invention in operation.
Figure 6:
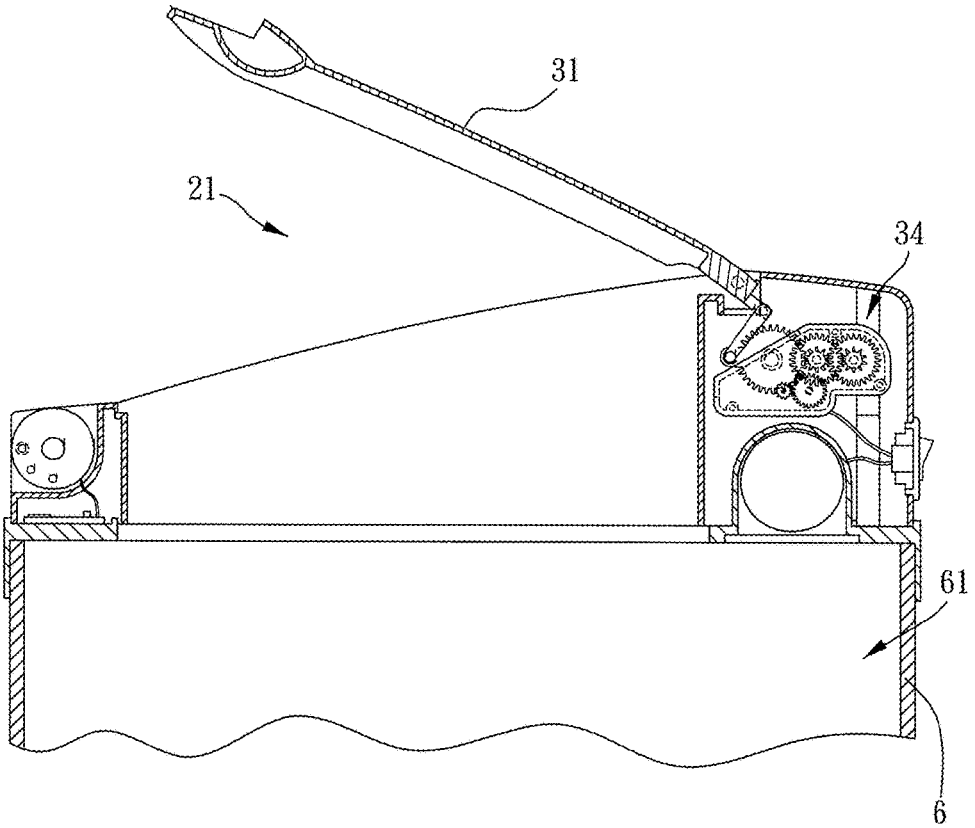
Figure 8:
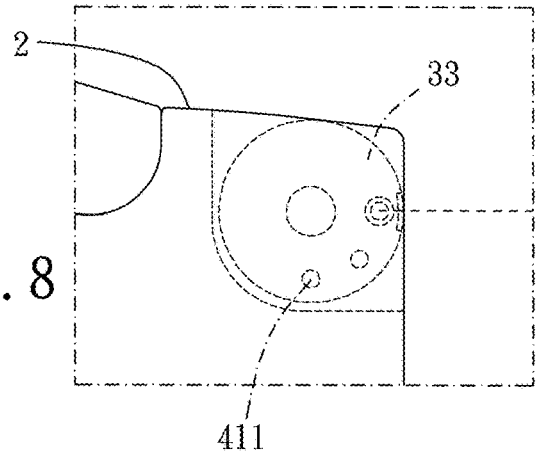
FIG. 8 is a partially-enlarged view of FIG. 7.

The present invention will be clearer from the following description when viewed together with the accompanying drawings, which show, for purpose of illustrations only, the preferred embodiment in accordance with the present invention.

Please refer to FIGS. 1 to 12 for a preferred embodiment of the present invention. A lid body 1 is provided for being assembled on a barrel body 6 and defining a receiving space 61 with the barrel body 6. It is to be noted that in this embodiment, the barrel body 6 is served as a garbage container for illustration only, and the lid body 1 includes a main body 2 and an opening and closing system 3.

Specifically, the main body 2 has an opening 21 for communicating with the receiving space 61. The opening and closing system 3 is disposed on the main body 2 and includes a lid member 31, a processing unit 32, at least one sensing unit 33 and a driving unit 34, the lid member 31 is movably assembled on the main body 2 and normally covers the opening 21, each said sensing unit 33 and an object to be sensed have a sensing distance 331 therebetween along a sensing direction, each said sensing unit 33 is angle-adjustably disposed on the main body 2, each said sensing unit 33 is electrically connected to the processing unit 32, the driving unit 34 is electrically connected to and between the processing unit 32 and the lid member 31. More specifically, a length of the sensing distance 331 projected to a detection plane 7 is defined as a detection range 8, and the detection range 8 changes according to change of the angle of the sensing unit 33 relative to the main body 2. It is to be noted that a length of the sensing distance 331 can be changed in accordance with different surroundings and requirements, and when the lid body 1 is used indoors, the sensing distance 331 is preferably 5 to 10 inches.

More specifically, as the sensing unit 33 senses the object, the sensing unit 33 transmits a signal to the processing unit 32; and as the processing unit 32 receives the signal, the processing unit 32 actuates the driving unit 34 to drive the lid member 31 to move to an opening position to cover the opening 21 partly so that a user can throw garbage through the opening 21 into the receiving space 61. More preferably, the opening and closing system 3 further includes a timer 35 which is electrically connected to the processing unit 32, the timer 35 is set for a preset time, when the lid member 31 moves to the opening position, the timer 35 starts to count, and when the timer 35 reaches the preset time, and the processing unit 32 controls the driving unit 34 to drive the lid member 31 to move to a position where the lid member 31 covers the opening 21 completely so as to make sure that an odor of the garbage in the receiving space 61 will not disseminate.

It is to be noted that the preset time is preferably 1 to 3 minutes in accordance with an amount of garbage to be thrown into a garbage container so that the lid member 31 will not open and close for multiple times in a short period of time, and the user has sufficient time to throw garbage. In addition, each said sensing unit 33 is preferably pivoted to the main body 2, and an angle of each said sensing unit 33 relative to the main body 2 is adjustable through rotation, so the sensing unit 33 has a simple structure and is easy and convenient to be assembled and operated. Of course, the angle of the sensing unit 33 relative to the main body 2 may be adjusted in other ways other than being pivoted to the main body 2; in other embodiments, for example but not limited to, the main body may have insertion portions in different angles, and the user can decide to insert the sensing unit into one of the insertion portions.

Preferably, the opening and closing system 3 further includes at least one positioning mechanism 4, a number of the at least one positioning mechanism 4 corresponds to a number of the at least one sensing unit 33, and the sensing unit 33 is held in a fixed angle relative to the main body 2 through the positioning mechanism 4 so that the sensing unit 33 will not shake due to unexpected external force (for example, impact). Specifically, each said positioning mechanism 4 has at least one first positioning unit 41 and at least one second positioning unit 42, the at least one first positioning unit 41 is disposed in the sensing unit 33, the at least one second positioning unit 42 is disposed in the main body 2, and one of the first positioning units 41 is optionally positioningly connected to one of the second positioning units 42. More specifically, a number of the at least one first positioning unit 41 is two, a number of the at least one second positioning unit 42 is two, and the at least one first positioning unit 41 and the at least one second positioning unit 42 are disposed on two sides of the sensing unit 33 opposite to each other so as to provide a more stable supporting force to position the sensing unit 33. The first positioning unit 41 and the second positioning unit 42 face each other, the first positioning unit 41 includes at least two recesses 411, the second positioning unit 42 includes a receiving portion 421, an elastic member 422 and an abutting member 423 which are disposed in the main body 2, the elastic member 422 is received in the receiving portion 421, the abutting member 423 is arranged between the first positioning unit 41 and the elastic member 422, and the elastic member 422 is configured to abut the abutting member 423 to move toward the first positioning unit 41 so that the abutting member 423 optionally abuts against one of the recesses 411 and is positioned thereon.

Each said positioning mechanism 4 further includes at least one first pivot portion 43 and at least one second pivot portion 44, and one of the at least one first pivot portion 43 and the at least one second pivot portion 44 includes at least one shaft hole 45 and the other of the at least one first pivot portion 43 and the at least one second pivot portion 44 includes at least one shaft 46 rotatably inserted into the at least one shaft hole 45. One of the at least one first positioning unit 41 and the at least one second positioning unit 42 includes the at least two recesses 411 and the other of the at least one first positioning unit 41 and the at least one second positioning unit 42 includes the abutting member 423. The at least two recesses 411 are separate from one another and disposed circumferentially around one of the at least one shaft hole 45 and the at least one shaft 46, and the abutting member 423 is adjustably and disengageably positioned within one of the at least two recesses 411. In this embodiment, the lid member 31 is pivoted to the main body 2, and the at least one sensing unit 33 is an infrared sensor; in other embodiments, the at least one sensing unit may be a sensor which senses distances via laser or ultrasound. A number of the at least one sensing unit 33 is one, and a place where the lid member 31 pivoted to the main body 2 and the sensing unit 33 are respectively located on two sides of the opening 21 facing each other. A number of the at least two recesses 411 is three, and the three recesses are equiangularly. Please refer to FIG. 4 and FIGS. 7 to 12. More specifically, a bearing face which bears the barrel body 6 is defined as the detection plane 7, when the abutting member 423 is positioningly located on the three recesses 411, and the sensing direction and the detection plane 7 are parallel or perpendicular to each other or have a 45 degree included angle therebetween; that is, three kinds of the detection ranges 8 are provided for the user to choose in accordance with different requirements.

Figure 7:
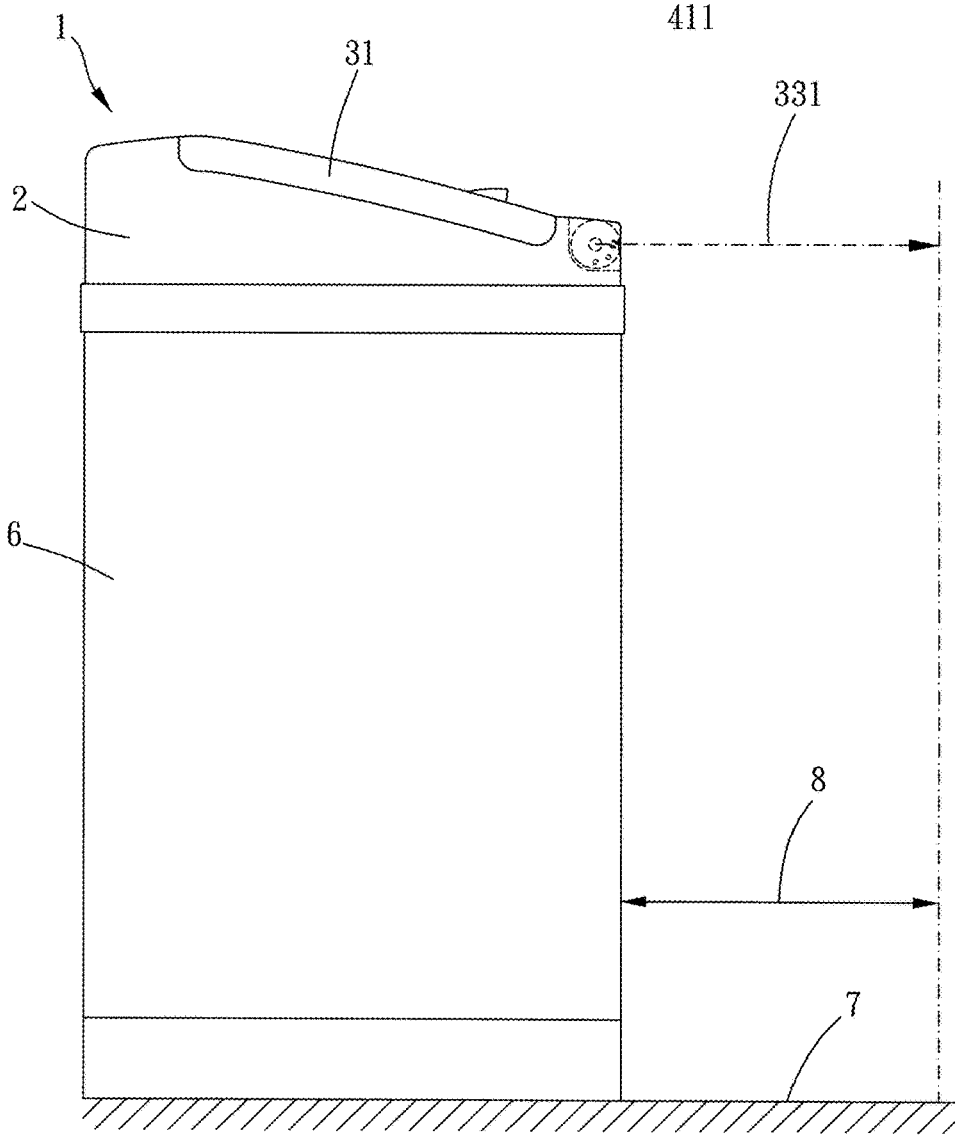
FIG. 7 is a drawing showing a sensing direction and a detection plane of the embodiment of the present invention parallel to each other.
Figure 10:
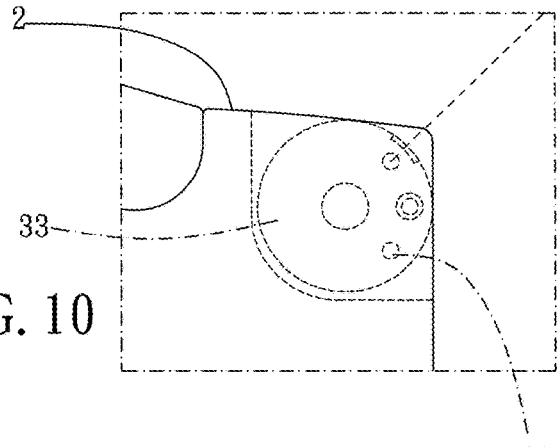
FIG. 10 is a partially-enlarged view of FIG. 9.
Figure 9:
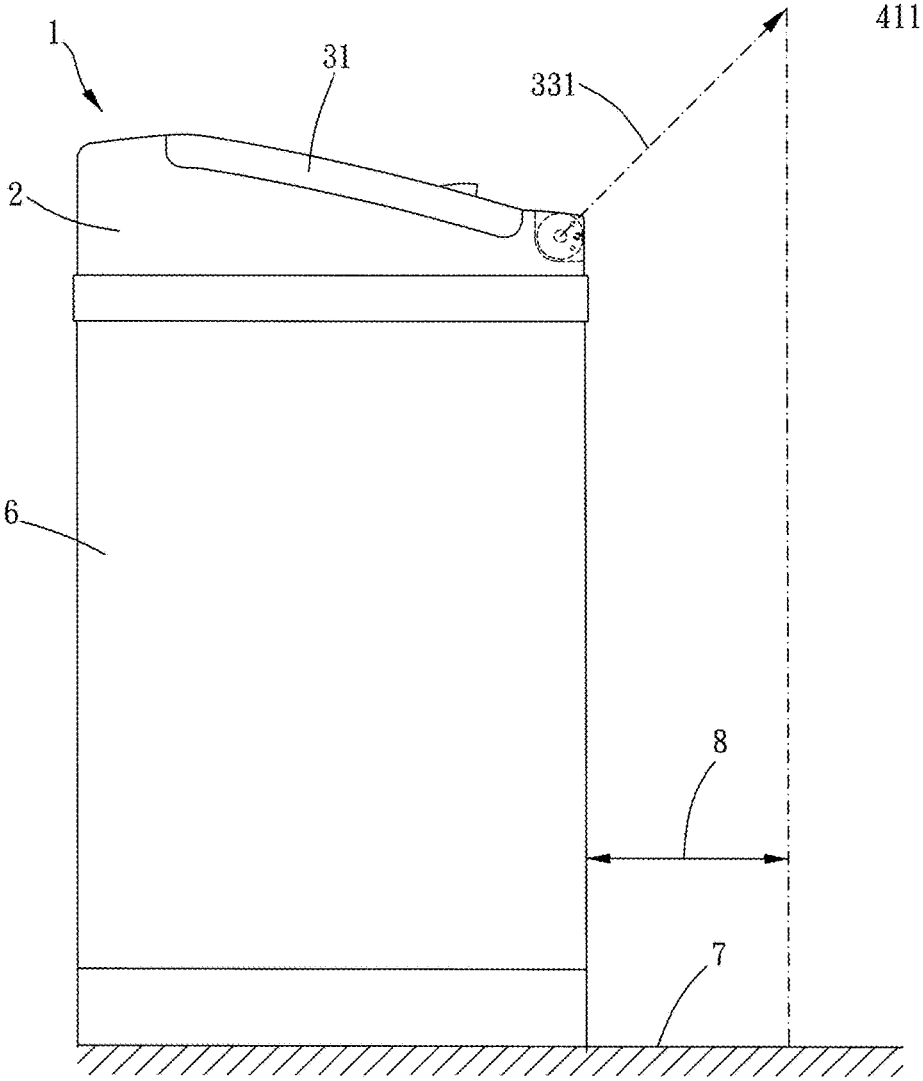
FIG. 9 is a drawing showing the sensing direction and the detection plane of the embodiment of the present invention having a 45 degree included angle therebetween.
Figures 11, 12:
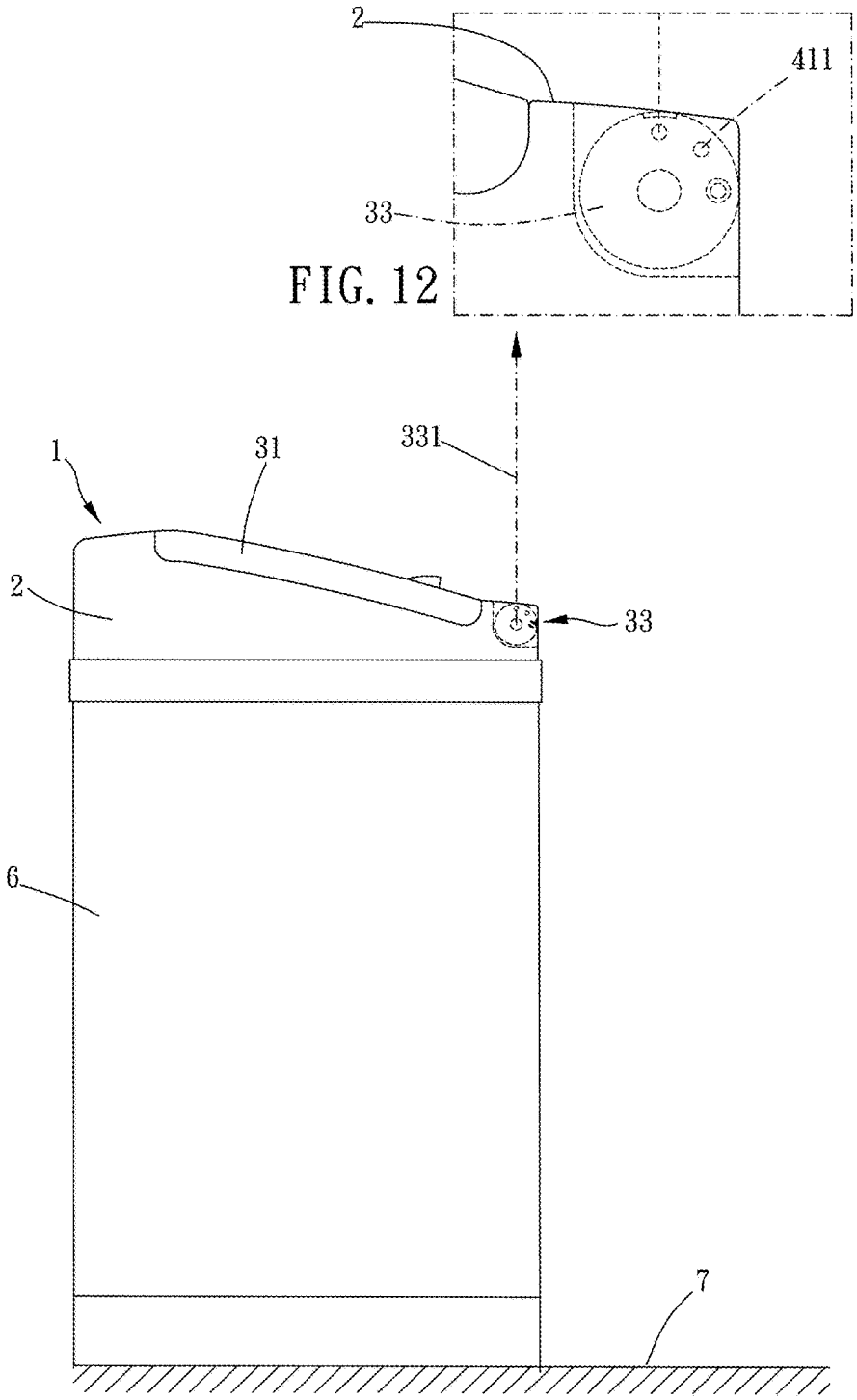
FIG. 11 a drawing showing the sensing direction and the detection plane of the embodiment of the present invention perpendicular to each other.
FIG. 12 is a partially-enlarged view of FIG. 11.

More specifically, in FIG. 7, it is obvious that when the sensing direction and the detection plane 7 are parallel to each other, the detection range 8 is the greatest and can detect a farthest distance (equal to the sensing distance 331), and the detection range 8 which is the greatest is suitable to be used when the user wants to throw garbage quickly and in an environment where has a large space and no other objects therearound. When the sensing direction is perpendicular to the detection plane 7 (as shown in FIG. 11), the detection range 8 is the smallest, the sensing unit 33 can only detects the object relatively above and cannot detect the user (or object) approaches on the detection plane 7. In other words, the user has to put his/her hand (or object) above the sensing unit 33 to make the lid member 31 open, and the detection range 8 which is the smallest is suitable to be used in an environment with a small space to prevent people from bypassing the lid body 1 or surrounding objects from accidentally causing the lid member 31 to open. In addition, when the sensing direction and the detection plane 7 have a 45 degree included angle therebetween, the detection range 8 is between the greatest and the smallest and suitable for an environment with a medium space where the user needs to approach the lid member 31 to trigger the lid member 31 to open so as to decrease the chance of the lid member 31 accidentally opens.

In addition, the lid body 1 further includes a power supply unit 5, the power supply unit 5 is disposed in the main body 2 and electrically connected to the processing unit 32 and the driving unit 34, and the power supply unit 5 is a battery box assembly; however, in other embodiments, the power supply unit 5 may supply electricity by plugging. The driving unit 34 includes a motor 341 and a decelerating gear set 342, the motor 341 and the decelerating gear set 342 are in a co-moving relation, the decelerating gear set 342 has a distal end gear 343, the distal end gear 343 extends radially to form a protrusive block 344, a linkage 345 is pivoted to and between the protrusive block 344 and the lid member 31, when the motor 341 starts, the decelerating gear set 342 is driven to rotate to make the protrusive block 344 drive the linkage 345 to move and further make the lid member 31 swing relative to the main body 2. Specifically, the decelerating gear set 342 can ensure that the lid member 31 opens stably and slowly to prevent the lid member 31 from opening too quickly and entailing other unexpected problems such as collision, shakes or structural damages.

Given the above, the lid member of the lid body can lift automatically, and the detection range of the sensing unit can be adjusted by the user according to various requirements. In addition, the positioning mechanism keeps the sensing unit in a fixed angle so that the sensing unit will not shake and deviate from the set angle due to collision. The lid body has a simple structure, and it is quick and easy to assemble and operate the lid body.

While we have shown and described various embodiments in accordance with the present invention, it should be clear to those skilled in the art that further embodiments may be made without departing from the scope of the present invention.

What is claimed is:

1. A lid body, for being assembled on a barrel body and defining a receiving space with the barrel body, the lid body including:

a main body, having an opening for communicating with the receiving space;

an opening and closing system, disposed on the main body, including a lid member, a processing unit, at least one sensing unit and a driving unit, the lid member being movably assembled on the main body and normally covering the opening, each said sensing unit and an object to be sensed having a sensing distance therebetween along a sensing direction, each said sensing unit being angle-adjustably disposed on the main body, each said sensing unit being electrically connected to the processing unit, the driving unit being electrically connected to and between the processing unit and the lid member;

wherein a length of the sensing distance projected to a detection plane is defined as a detection range, and the detection range changes according to change of the angle of the sensing unit relative to the main body;

wherein as the sensing unit senses the object, the sensing unit transmits a signal to the processing unit; and as the processing unit receives the signal, the processing unit actuates the driving unit to drive the lid member to move to an opening position to cover the opening partly;

wherein each said sensing unit is pivoted to the main body, the opening and closing system further includes at least one positioning mechanism, a number of the at least one positioning mechanism corresponds to a number of the at least one sensing unit, the sensing unit is held at a fixed angle relative to the main body through the positioning mechanism, each said positioning mechanism has at least one first positioning unit and at least one second positioning unit, the at least one first positioning unit is disposed on the sensing unit, the at least one second positioning unit is disposed on the main body, and one of the first positioning unit is positioningly connected to one of the second positioning unit;

wherein each said positioning mechanism further includes at least one first pivot portion and at least one second pivot portion, and one of the at least one first pivot portion and the at least one second pivot portion includes at least one shaft hole and the other of the at least one first pivot portion and the at least one second pivot portion includes at least one shaft rotatably inserted into the at least one shaft hole;

wherein one of the at least one first positioning unit and the at least one second positioning unit includes at least two recesses and the other of the at least one first positioning unit and the at least one second positioning unit includes an abutting member;

wherein the at least two recesses are separate from one another and disposed circumferentially around one of the at least one shaft hole and the at least one shaft, and the abutting member is adjustably and disengageably positioned within one of the at least two recesses.

2. The lid body of claim 1, wherein the opening and closing system further includes a timer which is electrically connected to the processing unit, the timer is set for a preset time, when the lid member moves to the opening position, the timer starts to count, and when the timer reaches the preset time, the processing unit controls the driving unit to drive the lid member to move to a position where the lid member covers the opening completely.

3. The lid body of claim 1, wherein the at least one sensing unit is an infrared sensor.

4. The lid body of claim 1, wherein the first positioning unit and the second positioning unit face each other, the first positioning unit includes the at least two recesses, the second positioning unit further includes a receiving portion and an elastic member which are disposed in the main body, the elastic member is received in the receiving portion, the abutting member is arranged between the first positioning unit and the elastic member, and the elastic member is configured to abut the abutting member to move toward the first positioning unit so that the abutting member abuts against one of the at least two recesses and is positioned thereon.

5. The lid body of claim 4, wherein a number of the at least two recesses is three, and the three recesses are arranged equiangularly.

6. The lid body of claim 5, wherein a bearing face which bears the barrel body is defined as the detection plane, when the abutting member is positioningly located on the three recesses, the sensing direction and the detection plane are parallel or perpendicular to each other or have a 45 degree included angle therebetween; when the sensing direction and the detection plane are parallel to each, the detection range is the greatest, and when sensing direction and the detection plane are parallel to each other, the detection range is the smallest.

7. The lid body of claim 6, wherein the opening and closing system further includes a timer which is electrically connected to the processing unit, the timer is set for a preset time, when the lid member moves to the opening position, the timer starts to count, and when the timer reaches the preset time, the processing unit controls the driving unit to drive the lid member to move to a position where the lid member covers the opening completely; the at least one sensing unit is an infrared sensor; the preset time is 1 to 3 minutes; the lid body further includes a power supply unit, the power supply unit is disposed in the main body and electrically connected to the processing unit and the driving unit, and the power supply unit is a battery box assembly; the lid member is pivoted to the main body, a number of the sensing unit is one, a place where the lid member pivoted to the main body and the sensing unit are respectively located on two sides of the opening facing each other, the driving unit includes a motor and a decelerating gear set, the motor and the decelerating gear set are in a co-moving relation, the decelerating gear set has a distal end gear, the distal end gear extends radially to form a protrusive block, a linkage is pivoted to and between the protrusive block and the lid member, when the motor starts, the decelerating gear set is driven to rotate to make the protrusive block drive the linkage to move and further make the lid member swing relative to the main body; the sensing distance is 5 to 10 inches; a number of the at least one first positioning unit is two, a number of the at least one second positioning unit is two, and the at least one first positioning unit and the at least one second positioning unit are disposed on two sides of the sensing unit opposite to each other.

* * * * *